US010274875B2

(12) United States Patent
Sako et al.

(10) Patent No.: US 10,274,875 B2
(45) Date of Patent: Apr. 30, 2019

(54) IMAGE FORMING APPARATUS AND MANAGEMENT SYSTEM FOR CALCULATING A DEGREE OF DETERIORATION OF A FIXING PORTION

(71) Applicant: CANON KABUSHIKI KAISHA, Tokyo (JP)

(72) Inventors: Toshiaki Sako, Mishima (JP); Shun-ichi Ebihara, Suntou-gun (JP); Tomonori Shida, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 67 days.

(21) Appl. No.: 15/336,140

(22) Filed: Oct. 27, 2016

(65) Prior Publication Data

US 2017/0123353 A1 May 4, 2017

(30) Foreign Application Priority Data

Oct. 29, 2015 (JP) ..... 2015-213023

(51) Int. Cl.
*G03G 15/20* (2006.01)
*G03G 15/00* (2006.01)

(52) U.S. Cl.
CPC ..... *G03G 15/2028* (2013.01); *G03G 15/6529* (2013.01)

(58) Field of Classification Search
CPC .. G03G 15/5029; G03G 15/55; G03G 15/553; G03G 2221/1663
See application file for complete search history.

(56) References Cited

U.S. PATENT DOCUMENTS 9,400,470 B1 * 7/2016 Miyoshi ..... G03G 15/55
2015/0323892 A1 * 11/2015 Sakamaki ..... G03G 15/20 399/327
2017/0060051 A1 * 3/2017 Tamaki ..... G03G 15/553

FOREIGN PATENT DOCUMENTS

| | | | |
|---|---|---|---|
| JP | 2000-131978 | A | 5/2000 |
| JP | 2000-284549 | A | 10/2000 |
| JP | 2012-133021 | A | 7/2012 |
| JP | 2012-141484 | A | 7/2012 |
| JP | 2012-226138 | A | 11/2012 |
| JP | 2014-178344 | A | 9/2014 |
| JP | 2016-009142 | A | 1/2016 |

* cited by examiner

*Primary Examiner* — Benjamin R Schmitt
*Assistant Examiner* — Milton Gonzalez
(74) *Attorney, Agent, or Firm* — Venable LLP

(57) ABSTRACT

An image forming apparatus includes a stacking portion, a feeding unit, an image forming unit, a storing unit, an inputting unit for inputting paper kind information of the recording material, and a calculating unit. When the paper kind information of the recording material inputted by the inputting unit is different from paper kind information of the recording material stored in the storing unit, the image forming unit forms the image on the recording material in an image forming condition determined on the basis of the paper kind information of the recording material inputted by the inputting unit, and the calculating means calculates the degree of deterioration of the feeding unit depending on the paper kind information of the recording material stored in the storing unit.

24 Claims, 9 Drawing Sheets

| SPECIES | MINIMUM THICKNESS(mm) | MAXIMUM THICKNESS(mm) |
|---|---|---|
| PLAIN PAPER | 0.099 | 0.107 |
| THIN PAPER | 0.075 | 0.098 |
| THICK PAPER | 0.108 | 0.23 |

(a)

| SPECIES | STIFFNESS($cm^3$/100) | FILLER CONTENT(%) |
|---|---|---|
| PLAIN PAPER | 120 | 18.5 |
| THIN PAPER | 100 | 18.5 |
| THICK PAPER | 160 | 18.5 |

(b)

FIG.4

IMAGE FORMING APPARATUS AND MANAGEMENT SYSTEM FOR CALCULATING A DEGREE OF DETERIORATION OF A FIXING PORTION

FIELD OF THE INVENTION AND RELATED ART

The present invention relates to an electrophotographic image forming apparatus such as a copying machine, a printer and a facsimile machine, and relates to a management system of the image forming apparatus.

Conventionally, the electrophotographic image forming apparatus is applied to the copying machine, the printer, the facsimile machine, or the like. In these image forming apparatuses, a user uses information on a kind of a recording material set by the user, and a thickness sensor is provided (for example, Japanese Laid-Open Patent Application (JP-A) 2000-284549) or a stiffness detection is made (for example, JP-A 2012-226138), so that a characteristic (property) of the recording material is acquired. The acquired characteristic of the recording material is used for determining an image forming condition, so that images with a predetermined quality can be formed on various recording materials.

In the electrophotographic image forming apparatus, consumables such as a toner supplying container and/or members including a photosensitive drum, a developing device, a fixing device, a transfer device and the like are mounted. Of these members, each of members having a lifetime shorter than a guaranteed operation time (lifetime) of a main assembly of the image forming apparatus is assembled into a unit. When these units reach ends of the lifetimes thereof, these units are replaced with fresh (new) units on a unit basis. As a result, these units meet continuous use of the image forming apparatus. However, in recent years, needs such that a management cost of the image forming apparatus is intended to be reduced increase. Also as regards the above-described units, it has been desired that the lifetimes of the units are detected or predicted with accuracy and then is notified and the management cost is reduced by lowering a frequency of replacement (exchange) of the units through use of the units for a long term until the units reach the ends of the lifetimes thereof.

In order to satisfy the lifetimes of the replaceable units with accuracy, there is a need to estimate a degree of a lowering in performance of each of the units (hereinafter referred to as a degree of deterioration) with accuracy. As a method of estimating the degree of deterioration of a rotation feeding means, for such a unit, relating to feeding of the recording material with accuracy, a method of monitoring the number of sheets of the recording material fed or the number of rotations (turns) of the rotation feeding means is used in general and is easy. In this method, at timing when the number of fed sheets of the recording material exceeds a predetermined number (of sheets) or at timing when the number of rotations of the rotation feeding means exceeds a predetermined number of rotations, a message of prewarning of the lifetime of the unit or a message that the lifetime of the unit reaches its end is displayed on a main assembly of the image forming apparatus or in a personal computer (PC) side where the PC is connected with the image forming apparatus. As the method of estimating the degree of deterioration of the unit with accuracy, the following methods are proposed. For example, a method in which depending on a difference in mode of the image forming apparatus (e.g., a difference in kind between plain paper and an OHT sheet) or depending on a difference in number of sheets of continuously fed recording materials, a calculation result is multiplied by a weighting efficiency has been proposed (e.g., JP-A 2000-131978). Further, a method in which estimation accuracy is improved depending on smoothness of a recording material detected by an image forming apparatus or depending on a basis weight of the recording material inputted by a user has been proposed (e.g., JP-A 2014-178344).

The estimation accuracy can be improved to some extent by taking the smoothness or the basis weight of the recording material into consideration when the degree of deterioration of the unit is estimated depending on the recording material used by the user. However, according to study by the present inventors, it turned out that the difference in degree of deterioration of the rotation feeding means generates in some cases although the image forming apparatus is operated under the same condition using the recording materials having the same smoothness and the same basis weight.

Further, for bringing a degree of finishing of printing near to a desired finishing degree, the user sets paper kind information of the recording material at a characteristic value different from an actually used recording material in some cases although the recording material to be used is not changed. In these cases, the degree of determination of the rotation feeding means is estimated on the basis of the characteristic value different from the actually used recording material, so that accuracy of estimation of actual degree of determination lowers.

SUMMARY OF THE INVENTION

The present invention has been accomplished in view of these circumstances. A principal object of the present invention is to provide an image forming apparatus and a management system which are capable of accurately estimating a degree of a lowering in performance of a feeding means depending on a paper kind of recording material to be used.

According to an aspect of the present invention, there is provided an image forming apparatus comprising: a stacking portion where a recording material is stacked; a feeding unit for feeding the recording material; an image forming unit for forming an image on the recording material fed by the feeding unit; a storing unit for storing information on the recording material stacked on the stacking portion in association with the stacking portion; an inputting unit for inputting paper kind information of the recording material; and a calculating unit for calculating a degree of deterioration of the feeding unit depending on the paper kind information of the recording material, wherein when the paper kind information of the recording material inputted by the inputting unit is different from paper kind information of the recording material stored in the storing unit, the image forming unit forms the image on the recording material in an image forming condition determined on the basis of the paper kind information of the recording material inputted by the inputting unit, and the calculating means calculates the degree of deterioration of the feeding unit depending on the paper kind information of the recording material stored in the storing unit.

According to another aspect of the present invention, there is provided an image forming apparatus comprising: a stacking portion where a recording material is stacked; a fixing portion for fixing a toner on the recording material while feeding the recording material; a storing unit for storing information on the recording material stacked on the stacking portion in association with the stacking portion; an inputting unit for inputting paper kind information of the recording material; and a calculating unit for calculating a degree of deterioration of the fixing portion depending on the paper kind information of the recording material, wherein when the paper kind information of the recording material inputted by the inputting unit is different from paper kind information of the recording material stored in the storing unit, the fixing portion fixes the toner image on the recording material at a temperature determined on the basis of the paper kind information of the recording material inputted by the inputting unit, and the calculating means calculates the degree of deterioration of the fixing portion depending on the paper kind information of the recording material stored in the storing unit.

According to another aspect of the present invention, there is provided a surface comprising: a plurality of image forming apparatuses; and a management apparatus connected with the image forming apparatuses via a network circuit, wherein each of the image forming apparatuses includes, a plurality of stacking portions where a recording material is stacked, a feeding unit for feeding the recording material, an image forming unit for forming an image on the recording material fed by the feeding unit, a storing unit for storing information on the recording material stacked on the stacking portion in association with the stacking portion, an inputting unit for inputting paper kind information of the recording material, and a calculating unit for calculating a degree of deterioration of the feeding unit depending on the paper kind information of the recording material, wherein the management apparatus includes, a setting unit capable of setting information on the recording material stacked on each of the stacking portions of the image forming apparatuses, for each of the stacking portions, and wherein when the paper kind information of the recording material inputted by the inputting unit is different from paper kind information of the recording material stored in the storing unit, the image forming unit forms the image on the recording material in an image forming condition determined on the basis of the paper kind information of the recording material inputted by the inputting unit, and the calculating means calculates the degree of deterioration of the feeding unit depending on the paper kind information of the recording material stored in the storing unit.

According to a further aspect of the present invention, there is provided a surface comprising: a plurality of image forming apparatuses; and a management apparatus connected with the image forming apparatuses via a network circuit, wherein each of the image forming apparatuses includes, a plurality of stacking portions where a recording material is stacked, a fixing portion for fixing an toner image on the recording material while feeding the recording material; a storing unit for storing information on the recording material stacked on the stacking portion in association with the stacking portion, an inputting unit for inputting paper kind information of the recording material, and a calculating unit for calculating a degree of deterioration of the fixing portion depending on the paper kind information of the recording material, wherein the management apparatus includes, a setting unit capable of setting information on the recording material stacked on each of the stacking portions of the image forming apparatuses, for each of the stacking portions, and wherein when the paper kind information of the recording material inputted by the inputting unit is different from paper kind information of the recording material stored in the storing unit, the fixes the toner image on the recording material at a temperature determined on the basis of the paper kind information of the recording material inputted by the inputting unit, and the calculating means calculates the degree of deterioration of the fixing portion depending on the paper kind information of the recording material stored in the storing unit.

Further features of the present invention will become apparent from the following description of exemplary embodiments with reference to the attached drawings.

BRIEF DESCRIPTION OF THE DRAWINGS

In FIG. 4, (a) and (b) are graphs each showing correspondence between kind and characteristic values of recording materials in Embodiments 1 and 2.

DESCRIPTION OF THE EMBODIMENTS

In the following, Embodiments of the present invention will be specifically described with reference to the drawings. An operation time guaranteed for a main assembly of an image forming apparatus or respective units is hereinafter referred to as a lifetime, and a degree of a lowering in performance of each of the units is hereinafter referred to as a degree of deterioration.

Embodiment 1

Figure 1:
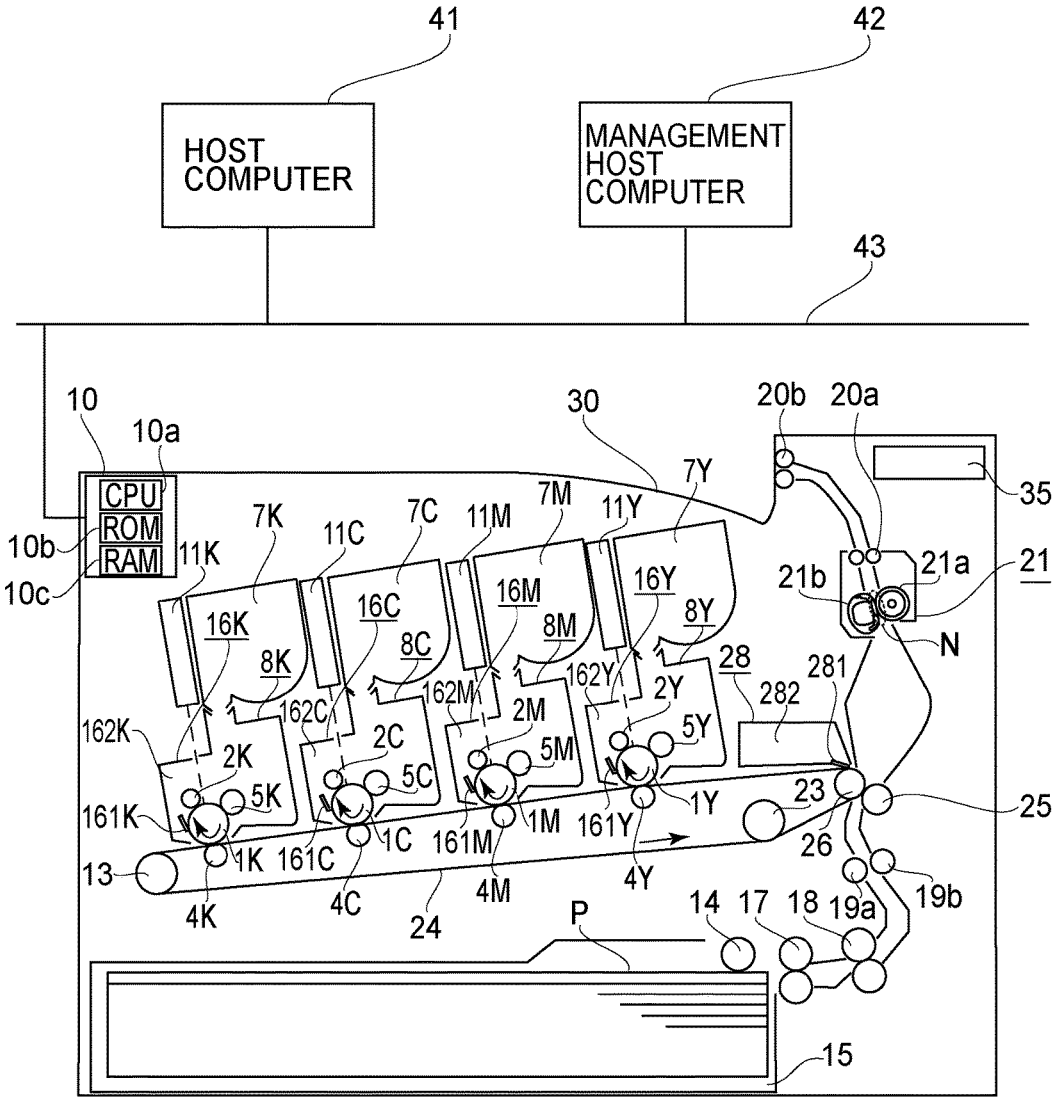
FIG. 1 is a schematic sectional view of an image forming apparatus in Embodiment 1.

In Embodiment 1, calculation of a lifetime of a rotation feeding means constituting an image forming apparatus is made depending on a paper kind of a recording material. FIG. 1 is a schematic sectional view of the image forming apparatus in this embodiment. In this embodiment, as an example of the image forming apparatus, a color image forming apparatus using an intermediary transfer belt is used, but an image forming apparatus having another constitution may also be used.

[Image Forming Apparatus]

The image forming apparatus in this embodiment is a printer of a 4-drum full-color type. An image forming portion is constituted by stations of colors of yellow (Y), magenta (M), cyan (C) and black (K), in which photosensitive drums 1Y, 1M, 1C and 1K are provided, respectively, as image bearing members. The image forming portion includes a charging roller 2 as a charging means, a scanner portion 11, a developing device 8 as a developing means (e.g., developing devices 8Y, 8M, 8C, and 8K for colors yellow, magenta, cyan, and black, respectively), a toner container 7 as a toner supplying means (e.g., toner containers 7Y, 7M, 7C, and 7K for colors yellow, magenta, cyan, and black, respectively), a drum cleaner 16, an intermediary transfer belt 24 as a rotatable member, and a secondary transfer roller 25. Incidentally, the suffixes Y, M, C and K for representing the colors will be omitted hereinafter except for a necessary case. Further, the image forming portion includes a driving roller 26 functioning as an opposing roller to the secondary transfer roller 25 while driving the intermediary transfer belt 24, a stretching roller 13, an auxiliary roller 23, a primary transfer roller 4, and a fixing portion 21 as a fixing means. The image forming portion further includes a control calculating portion 10 as a calculating means for controlling an operating the above-described means.

The control calculation portion 10 effects system control of the image forming apparatus shown in FIG. 1 and includes CPU 10*a* for effecting the system control of the image forming apparatus, ROM 10*b* in which a control program is written, and RAM 10*c* for storing data used in control and image data. The ROM 10*b* is a storing means in a non-volatile memory capable of maintaining a stored value even when electric power supply to the image forming apparatus is stopped. The photosensitive drum 1 is constituted by applying an organic photoconductive layer onto an outer peripheral surface of an aluminum cylinder, and a driving force of an unshown driving motor is transmitted to the photosensitive drum 1, so that the photosensitive drum 1 is rotated. The driving motor rotates the photosensitive drum 1 in an arrow direction (clockwise direction) in FIG. 1 depending on an image forming operation.

When the control calculating portion 10 receives an image signal, a recording material P is fed from a sheet feeding cassette 15, which is a stacking portion where sheets of the recording material P are stacked, into the image forming apparatus by a pick-up roller 14 and feeding rollers 17 and 18. Then, the fed recording material P is once sandwiched (nipped) between roller-shaped synchronization rotatable members for achieving synchronization between an image forming operation described later and the feeding of the recording material P, i.e., a registration roller pair 19*a* and 19*b*, and is kept at rest and on stand-by. In FIG. 1, the image forming apparatus includes a single sheet feeding cassette 15 but may also include a plurality of sheet feeding cassettes.

On the other hand, the control calculating portion 10 controls the scanner portion 11, so that an electrostatic latent image depending on the received image signal is formed by the scanner portion 11 on the surface of the photosensitive drum 1 electrically charged to a certain potential by the charging roller 2. The developing device 8 is a means for visualizing the electrostatic latent image on the photosensitive drum 1 and effects development for each of colors of Y, M, C and K of the stations. The developing device 8 includes a developing roller 5 to which a developing voltage for visualizing the electrostatic latent image is applied. In this way, the electrostatic latent image formed on the surface of the photosensitive drum 1 is developed into a single-color toner image by the developing device 8.

The intermediary transfer belt 24 contacts the photosensitive drum 1 during color image formation and rotates, in synchronism with rotation of the photosensitive drum 1, in an arrow direction (counterclockwise direction) in FIG. 1. The single-color toner images into which the electrostatic latent images are developed are successively transferred superposedly onto the intermediary transfer belt 24 by a primary-transfer voltage applied to the primary transfer rollers 4, so that a multi-color toner image is formed on the intermediary transfer belt 24. A toner remaining on each of the photosensitive drums 1 without being transferred onto the intermediary transfer belt 24 is collected by the drum cleaner 16 in contact with the photosensitive drum 1. The drum cleaner 16 includes a cleaning blade 161 and a toner collecting container 162.

The multi-color toner image formed on the intermediary transfer belt 24 is fed to a secondary transfer nip formed by the intermediary transfer belt 24 and the secondary transfer roller 25. The feeding of the recording material P kept on the stand-by in a state in which the recording material P is sandwiched between the conveying rollers 19*a* and 19*b* is resumed in synchronism with timing of the feeding of the toner images on the intermediary transfer belt 24 to the secondary transfer nip. The recording material P is fed to the secondary transfer nip by the conveying rollers 19*a* and 19*b* while achieving the synchronization with the feeding of the multi-color toner image on the intermediary transfer belt 24. Then, the multi-color toner image on the intermediary transfer belt 24 is transferred altogether onto the recording material P fed to the secondary transfer nip by a secondary transfer voltage applied to the secondary transfer roller 25.

The fixing portion 21 is roughly constituted by a pressing roller 21*a* which has an elastic layer and which is rotatable and by a rotatable heating member 21*b* which is press-contacted to the pressing roller 21*a* to form a fixing nip N and which includes a heater or the like which a heating means for heating the recording material P at the fixing nip N formed between itself and the pressing roller 21*a*.

[Fixing Portion]

Figure 2:
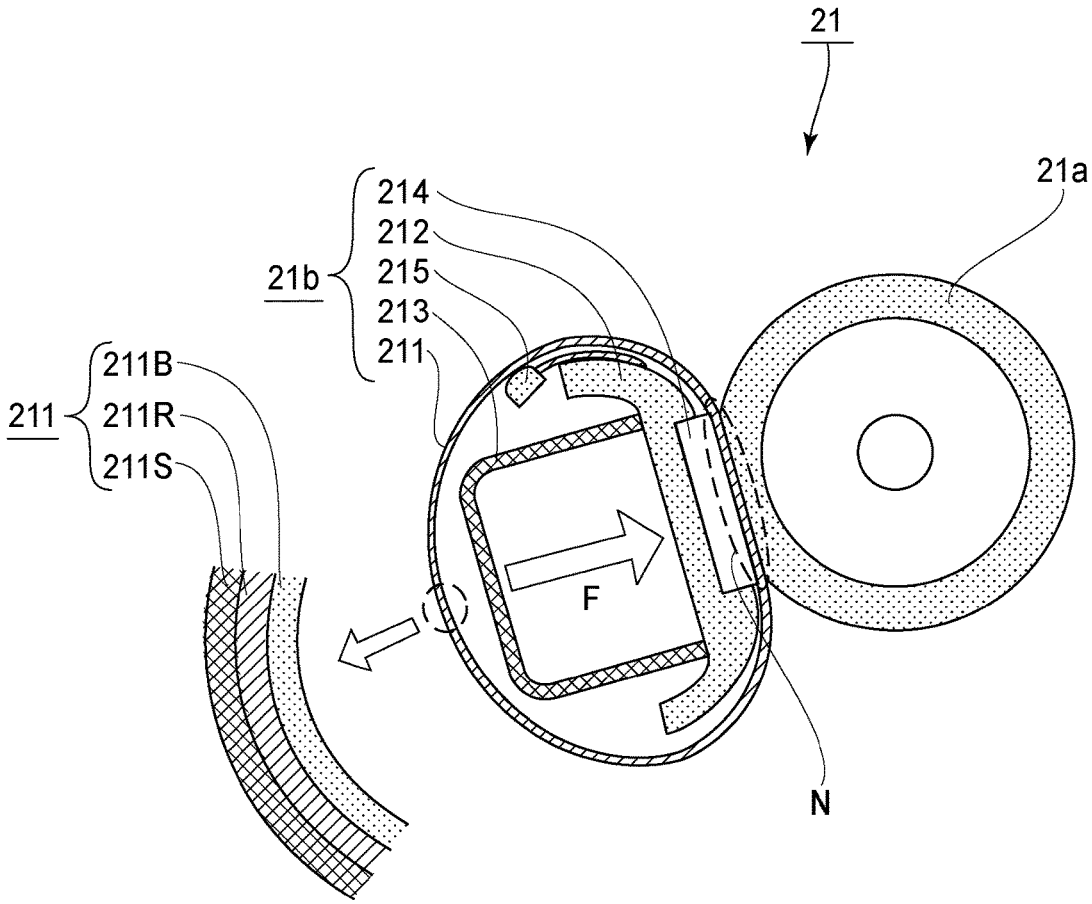
FIG. 2 is a schematic sectional view of a fixing portion in Embodiments 1 and 2.

FIG. 2 is a schematic structural view of the fixing portion 21. A heat-resistant cylindrical heating film 211 constituting the rotatable heating member 21*b* is loosely engaged around an outer periphery of a supporting holder 212 for holding the heating film 211 in a cylindrical shape and a metal-made fixing stay 213 for holding (supporting) the supporting holder 212. A plate-shaped heat generating member 214 is supported by the supporting holder 212 with respect to a longitudinal direction, and is pressed toward the pressing roller 21*a* via the heating film 211 by an unshown pressing means with a pressing force F, so that the fixing nip N is formed. The heating film 211 sandwiched between the pressing roller 21*a* and the plate-shaped heat generating member 214 is rotated around the supporting holder 212 and the fixing stay 213 relative to the pressing roller 21*a*. A temperature sensor 215 as a temperature detecting means contacts an inner surface of the heating film 211 and detects an inner surface temperature of the heating film 211. On the basis of the detected temperature, the control calculating portion 10 effects control so that the temperature of the heating film 211 is a predetermined temperature. The heating film 211 in this embodiment is prepared by successively forming a 300 μm-thick elastic layer 211R and a 25 μm-thick parting layer 211S in a named order on a 35 μm-thick film 211B. The film 211B includes a stainless material layer as a base layer. The elastic layer 211R is formed with a heat-conductive silicone rubber, and the parting layer is formed of a PFA material.

The recording material P on which the multi-color toner image is carried is not only fed by the pressing roller 21*a* but also subjected to application of heat and pressure at the fixing nip N, so that an unfixed multi-color toner image is fixed on the surface of the measurement result P. Referring again to FIG. 1, the recording material P on which the toner image is fixed is discharged onto a sheet discharge tray 30 by discharging rollers 20*a* and 20*b*, so that the image forming operation is ended. A belt cleaner 28 removes the toner remaining on the intermediary transfer belt 24 after the toner image is transferred onto the recording material by a cleaner blade 281, and the collected toner is stored in a cleaner container 282.

The above-described series of steps of the image forming operation is controlled by the control calculating portion 10. The control calculating portion 10 is connected with a control panel 35 which is an inputting means, and is connected with a host computer which is an inputting means and with a management host computer 42 which is a management apparatus, via a network circuit 43. Further, the control calculation portion 10 controls the image forming apparatus depending on a command and setting information inputted from the host computer 41 and the management host computer 42. Further, the control calculating portion 10 also functions as a notifying means for notifying the user of states of the image forming apparatus and respective units by an alert sound and message display and as a calculating means for calculating a lifetime of a rotation feeding means of the image forming apparatus as described later. Further, the control calculating portion 10 also functions as a storing means for storing various parameters necessary for the calculating means for calculating the lifetime of the rotation calculating means.

The host computer 41 is a computer for making a request of printing when a "general user" described later executes image formation by the image forming apparatus, and sends image data to be used for the printing to the image forming apparatus together with the request of printing. The host computer 41 makes setting of an image forming condition depending on input by the "general user". The management host computer 42 effects management (control) of data setting of the image forming apparatus and monitoring of an operation status and sends data of stiffness and a filler content of the recording material P.

[Control Calculation Portion]

Figure 3:
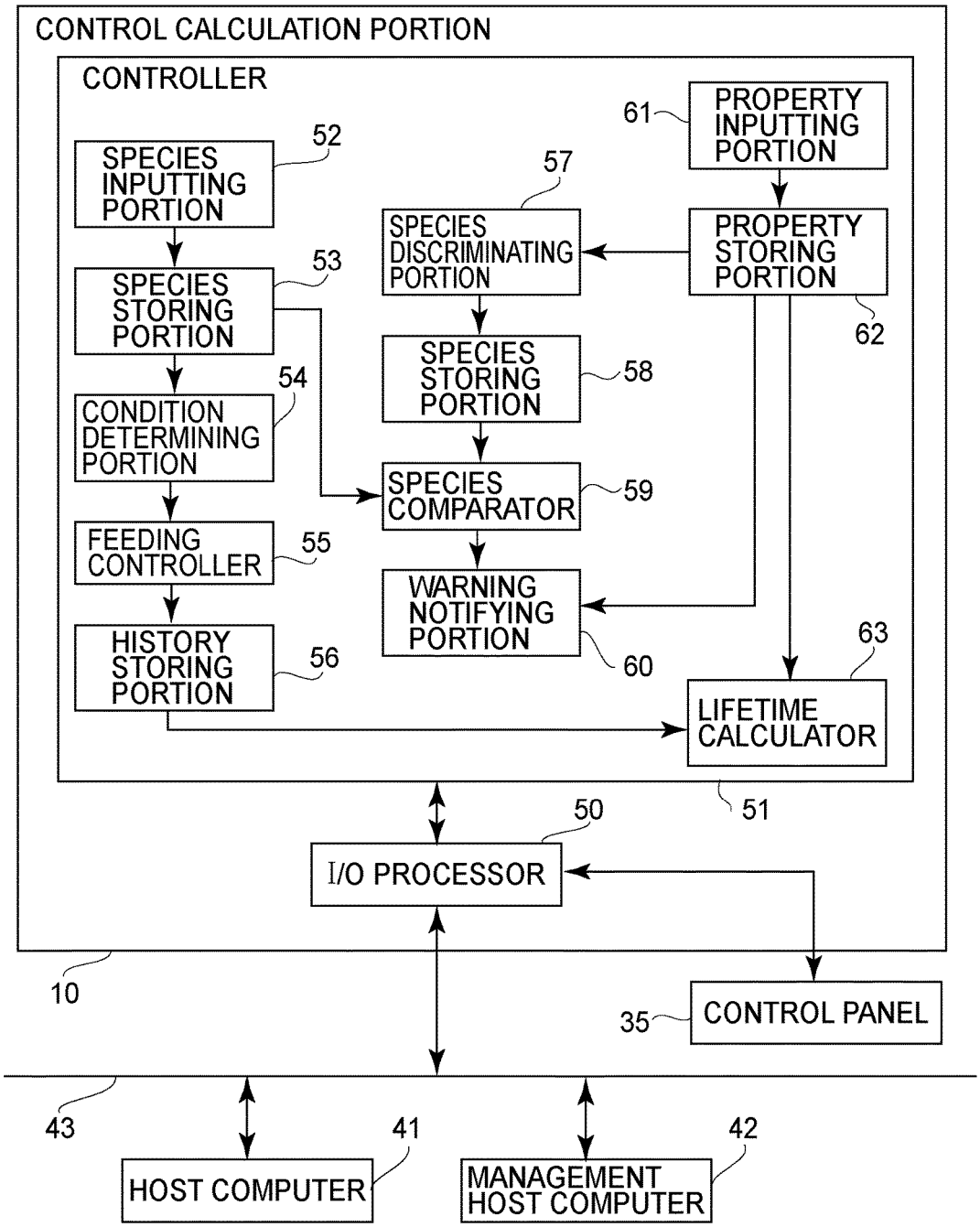
FIG. 3 is a block diagram showing a structure of a control calculation portion of the image forming apparatus in Embodiment 1.

A characteristic constitution of the control calculation portion 10 in this embodiment will be described using FIG. 3. FIG. 3 is a function black diagram showing a structure of the control calculation portion 10 of the image forming apparatus in this embodiment. An input output processing portion 50 is an interface portion for controlling communication of the host computer 41 and the management host computer 42 which are connected with a network circuit 43 with a controller 51. The input output processing portion 50 sends information from the controller 51 for displaying the information at the control panel 35 and sends information inputted through the control panel 35. The input output processing portion 50 sends the information from the controller 51 to the host computer 41 and the management host computer 42 and sends information received from the host computer 41 and the management host computer 42 to the controller 51.

The controller 51 operates the image forming apparatus on the basis of the information received from the control panel 35, the host computer 41 and the management host computer 42 via the input output processing portion 50. Further, the controller 51 sends information such as status of the image forming apparatus and respective units and the like to the input output processing portion 50, whereby the information is displayed on the control panel 35 or is sent to the host computer 41 and the management host computer 42.

A sheet kind inputting portion 52 receives information of a kind, of the recording material P used for printing, selected by the general user from a menu displayed on the control panel 35, via the input output processing portion 50, and stores the information in an inputted sheet kind storing portion 53. Here, the "general user" refers to a user who executes image formation (printing) on a desired recording material P by using the image forming apparatus. The kind of the recording material P refers to a general category (paper kind) of the recording material, such as plain paper, thin paper or thick paper. An image forming condition determining portion 54 determines the image forming condition on the basis of the recording material kind information stored in the inputted sheet kind storing portion 53. The "image forming condition" referred to herein is a feeding speed of the recording material P, a control temperature (fixing temperature) of the fixing portion 21 depending on the recording material P, and values of the voltages, such as a developing voltage, a primary transfer voltage and a secondary transfer voltage, depending on the recording material P. A feeding controller 55 drives feeding rollers including a pressing roller 21*a* of the fixing portion 21 on the basis of the feeding speed of the recording material P determined by the image forming condition determining portion 54, so that the recording material P fed from the sheet feeding cassette 15 is fed. A feeding history of the recording material P is recorded in a feeding history recording portion on the basis of a result of an operation of the feeding controller 55. Information recorded as the feeding history in the feeding history recording portion 56 is the number of sheets of the fed recording materials P and the number of rotations (turns) of the heating film 21.

A sheet characteristic inputting portion 61 stores characteristic value information of the recording material P, in an inputted sheet characteristic value storing portion 62, inputted by a management user through a menu displayed on the control panel 35 or the management host computer 42. Here, the "management user" refers to a user who effects maintenance and management (control) of the image forming apparatus. Further, the characteristic value of the recording material P refers to information indicating a thickness, stiffness and a filler content of the recording material P. In this embodiment, as the information on the thickness of the recording material P, a value obtained by "Determination of thickness and density" according to JIS P 8118 is used, and as the information on the stiffness, a value obtained by "Clark stiffness tester method" according to JIS P 8143 is used. Further, in this embodiment, as the information on the filler content of the recording material P, a value obtained by "Determination of residue (ash) on ignition at 525 degree C." according to JIS P 8251 is used. For example, the inputted characteristic values of the recording material P are 0.100 (mm) as the thickness information, 116.4 ($cm^3$/100) as the stiffness information, 19.6% as the filler content information, and the like.

A sheet kind discriminating portion 57 discriminates the kind of the recording material P from the thickness information of the recording material P of pieces of characteristic value information of the recording material P stored in the inputted sheet characteristic value storing portion 62, and stores the kind of the recording material P in a discriminated sheet kind storing portion 58. In FIG. 4, (a) is an example of a table in which a minimum and a maximum of the thickness of the recording material P are associated with each other for each of kind (paper kind) of the recording materials P. In (a) of FIG. 4, a left column shows the kind of the recording material, a center column shows the minimum (unit: mm) of the thickness of the recording material P, and a right column shows the maximum (unit: mm) of the thickness of the recording material P. In (a) of FIG. 4, the kind of the recording material includes the plain paper, the thin paper and the thick paper, and thicknesses of these papers are defined as 0.099 mm-0.107 mm for the plain paper, 0.075 mm-0.098 mm for the thin paper, and 0.108 mm-0.23 mm for the thick paper. On the basis of the correspondence table of the minimum and the maximum of the thickness of the recording material P for each of the kinds of the recording materials P shown in (a) of FIG. 4, the sheet kind discriminating portion 57 discriminates the kind of the recording material P by using the thickness information of the characteristic values of the recording material P stored in the inputted sheet characteristic value storing portion 62, and stores the kind of the recording material P in the discriminated sheet kind storing portion 58. Specifically, the sheet kind discriminating portion 57 selects the kind of the recording material P for which a thickness value of the recording material P of the characteristic values falls between the minimum thickness value and the maximum thickness value which are shown in (a) of FIG. 4. In this embodiment, the kind of the recording material P is discriminated by inputting the thickness of the sheet (recording material), but for example, the kind of the recording material P may also be discriminated by inputting a basis weight or may also be directly inputted.

A sheet kind comparing portion 59 compares the kind of the recording material P stored in the discriminated sheet kind storing portion 58 with the kind of the recording material P stored in the inputted sheet kind storing portion 53. As a result of the comparison of the kind of the recording material P by the sheet kind comparing portion 59, as the case where these two kinds do not coincide with each other, the following two cases would be considered. One is the case where the general user changes the recording material P to be actually used to a recording material P having a different kind, and the other is the case where the general user changes only data setting for the sheet kind. The case where the general user changes only data setting for the sheet kind refers to the case where the general user intentionally changes the data to the recording material P having the different kind in order to change a degree of finishing of the printing. For example, the case is such that although the printing is made on the plain paper in actuality, the general user changed data so as to make printing in an operation in a thick paper mode in order to ensuring gloss (glossiness) of a printed image.

Accordingly, in the case where the kinds of the recording materials P do not coincident with each other on the basis of the comparison result, the sheet kind comparing portion 59 causes a warning notifying portion 60 to send a notifying message to the management host computer 42 in order to check the characteristic value of the recording material P. Then, when the management host computer 42 receives the message for the purpose of checking the characteristic value, the characteristic value checking message is displayed on, e.g., a display portion in order to notify the management user of the message. When the message is notified to the management user, the management user checks the kind of the recording material P to be actually used. As a result, when the kind of the recording material P to be actually used is changed to the different kind of the recording material P, a new characteristic value is inputted by the management user. Thus, the new characteristic value is inputted from the sheet characteristic inputting portion 61, so that the characteristic value of the recording material stored in the inputted sheet characteristic value storing portion 62 is renewed. Incidentally, in the case where the kind of the recording material P to be actually used is not changed but only the data setting is changed, the same characteristic value is inputted again by the management user. Depending on the input of the characteristic value, the sheet characteristic comparing portion 59 clears a message indicating that there is a need to check the characteristic value of the recording material displayed on the management host computer 42 through the warning notifying portion 60.

As described later, a lifetime calculating portion 63 calculates a lifetime of the fixing portion 21 by using the information of the feeding history stored in the feeding history recording portion 56 and the characteristic value of the recording material stored in the inputted sheet characteristic value storing portion 62. Then, the lifetime calculating portion 63 not only displays a calculation result on the control panel 35 through the input output processing portion 50 but also sends the calculation result to the host computer 41 and the management host computer 42.

The controller 51 described above is the CPU 10*a* of the control calculation portion 10, and a control block shown in FIG. 3 includes the RAM 10*c* in which functions (processes) executed by the CPU 10*a* on the basis of a program stored in the ROM 10*b* and data (information) are stored. That is, in the control block, functions (processes) executed by the CPU 10*a* are represented as the sheet kind inputting portion 52, the image forming condition determining portion 54, the feeding controller 55, the sheet kind discriminating portion 57, the sheet kind comparing portion 59, the warning notifying portion 60, the sheet characteristic inputting portion 61 and the lifetime calculating portion 63. Further, the inputted sheet kind storing portion 53, the feeding history recording portion 56, the discriminated sheet kind storing portion 58 and the inputted sheet characteristic value storing portion 62 constitute the RAM 10*c*. In the following the respective processes executed by the CPU 10*a* will be described using names of the functional blocks shown in FIG. 3.

[Calculating Method of Lifetime]

A lifetime calculating method of the fixing portion 21 carried out by the lifetime calculating portion 63 will be described. The lifetime calculating portion 63 predicts and calculates a degree of determination of the fixing portion 21 and makes lifetime calculation on the basis of a value acquired by the calculation. In the lifetime calculation of the fixing portion 21, the degree of determination of the fixing portion 21 is predicted and calculated using an abrasion amount of the parting layer 211S of the heating film 211 which is a rotatable means. In this embodiment, the degree of determination of the fixing portion 21 is predicted and calculated using two abrasion amounts. One is an abrasion amount when the recording material P is used for printing, and on the assumption that in the case where the image is printed on one page (sheet) of the recording material P, the parting layer 211S is abraded in an amount of $0.84\times10^{-4}$ μm, the abrasion amount is calculated. The other is an abrasion amount when the heating film 211 is rotated. Irrespective of whether or not the image is printed on the recording material P, when the heating film 211 is rotated, the parting layer 211S is abraded, and therefore the abrasion amount is calculated on the assumption that the abrasion amount is $0.17\times10^{-5}$ per rotation of the heating film 211.

The lifetime calculating portion 63 hold, in the feeding history recording portion 56, an integrated abrasion amount during the printing of the image on the recording material P as an integrated abrasion amount 1 which is a first abrasion amount and an integrated abrasion amount during the rotation of the heating film 211 as an integrated abrasion amount 2 which is a second abrasion amount. Each of the integrated abrasion amounts 1 and 2 is a predicted value in the prediction calculation, and when the abrasion amount of the heating film 211 is estimated as an excessively small value, the heating film 211 reaches an end of an actual lifetime thereof earlier than the calculated lifetime, so that there is a liability that image defect generates. For that reason, the lifetime calculating portion 63 uses a larger integrated abrasion amount of the integrated abrasion amounts 1 and 2, as the integrated abrasion amount of the heating film 211 in the lifetime calculation. Incidentally, a result of the lifetime calculation providing a degree that the integrated abrasion amount approaches a predetermined lifetime value of the fixing portion 21 is represented by a percentage. An initial value of a thickness of the parting layer 211S of the fixing portion 21 used in this embodiment is 25 μm. However, when abrasion (wearing) of the parting layer 211S progresses and a thickness of the parting layer 211S becomes excessively thin, there is a liability that a minute crack generates in the parting layer 211S and an effect of a parting performance is not sufficiently achieved and thus an image quality lowers. Accordingly, in this embodiment, the lifetime value of the integrated abrasion amount of the parting layer 211S is 23 μm, and the lifetime calculation is made by the lifetime calculating portion 63 according to a formula (1) below.

In the formula (1), a remaining lifetime of the parting layer 211S is acquired. Here, the lifetime value refers to an integrated value of the abrasion amount of the parting layer 211S, and in this embodiment, when the integrated value of the abrasion amount of the parting layer 211S is 23 μm, the fixing portion 21 is regarded as reaching the end of its lifetime. In other words, when the thickness of the parting layer 211S is 2 μm (=25 μm-23 μm), the fixing portion 21 is regarded as reaching the end of the lifetime thereof. The time when the integrated value of the abrasion amount of the parting layer 211S is 23 μm is timing of exchanging the fixing portion 21.

$$\text{Remaining lifetime (\%)}=(1-(\text{integrated abrasion amount } (\mu m)/23))\times 100 \quad (1)$$

A calculation result of the remaining lifetime by the formula (1) is sent via the input output processing portion 50 to the control panel 35, and the control panel 35 displays the remaining lifetime and notifies the user of the remaining lifetime.

Incidentally, it is known that the abrasion amount of the parting layer 211S varies depending on the stiffness and the filler content of the recording material P to be fed.

In this embodiment, as the prediction calculation value of the degree of deterioration, the abrasion amount of the parting layer 211S in the heating film 211 is calculated and corrected by the lifetime calculating portion 63 depending on the stiffness and the filler content of the recording material. The correction efficiency is obtained by the lifetime calculating portion 63 from a matrix shown in FIG. 5 depending on the stiffness and the filler content of the recording material P and then the lifetime calculating portion 63 corrects the calculated abrasion amount.

Figure 5:
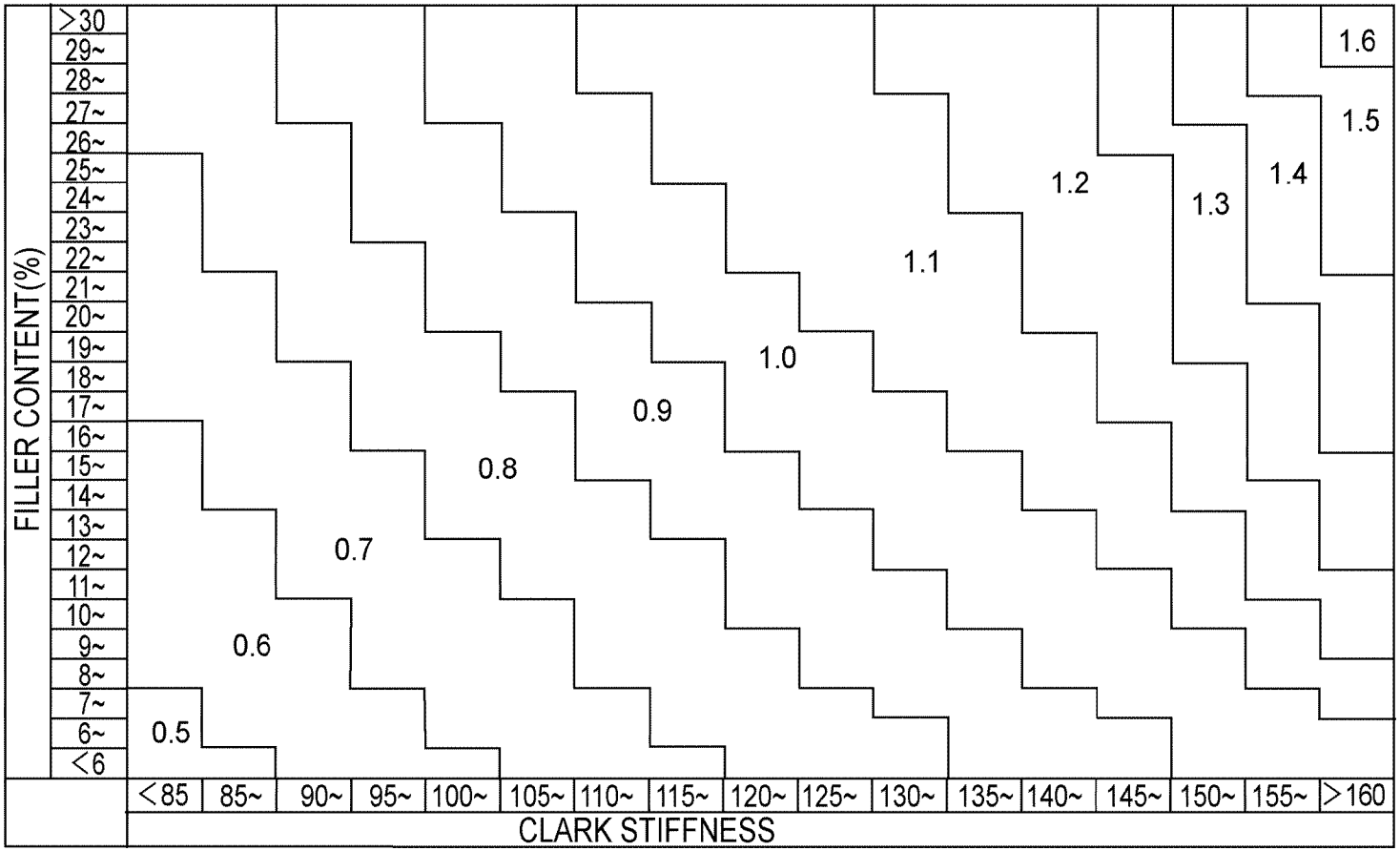
FIG. 5 is an illustration of a correction efficiency matrix in Embodiments 1 and 2.

FIG. 5 shows the matrix in which the abscissa is the Clark stiffness and the ordinate is the filler content (%) and in which the correction efficiency at a predetermined Clark stiffness and a predetermined filler content is shown. The correction efficiency is in the range from 0.5 to 1.6. The correction efficiency is set at a smaller value with a decreasing stiffness and with a decreasing filler content. For example, in the case where the Clark stiffness of the recording material P set from the management host computer 42 is 120 or more and less than 125 and the filler content (%) is 14 or more and less than 15, the correction efficiency is 0.9. As a result, also in either of the integration methods on the page number basis of the recording material P and on the rotation number basis of the heating film 211, the abrasion amount of the parting layer 211S can be predicted further accurately. The lifetime calculating portion 63 holds the matrix shown in FIG. 5 and acquires a value of the matrix as a correction efficiency of the abrasion amount on the basis of the stiffness and the filler content of the recording material P which are held by the inputted sheet characteristic value storing portion 62. Then, when the lifetime calculating portion 63 calculates the integrated abrasion amounts 1 and 2, the lifetime calculating portion 63 integrates a value obtained by multiplying the abrasion amount per page of the recording material and the abrasion amount per rotation of the heating film 211 by the acquired correction efficiency of the abrasion amount.

[Lifetime Calculating Process of Fixing Portion]

Figure 6:
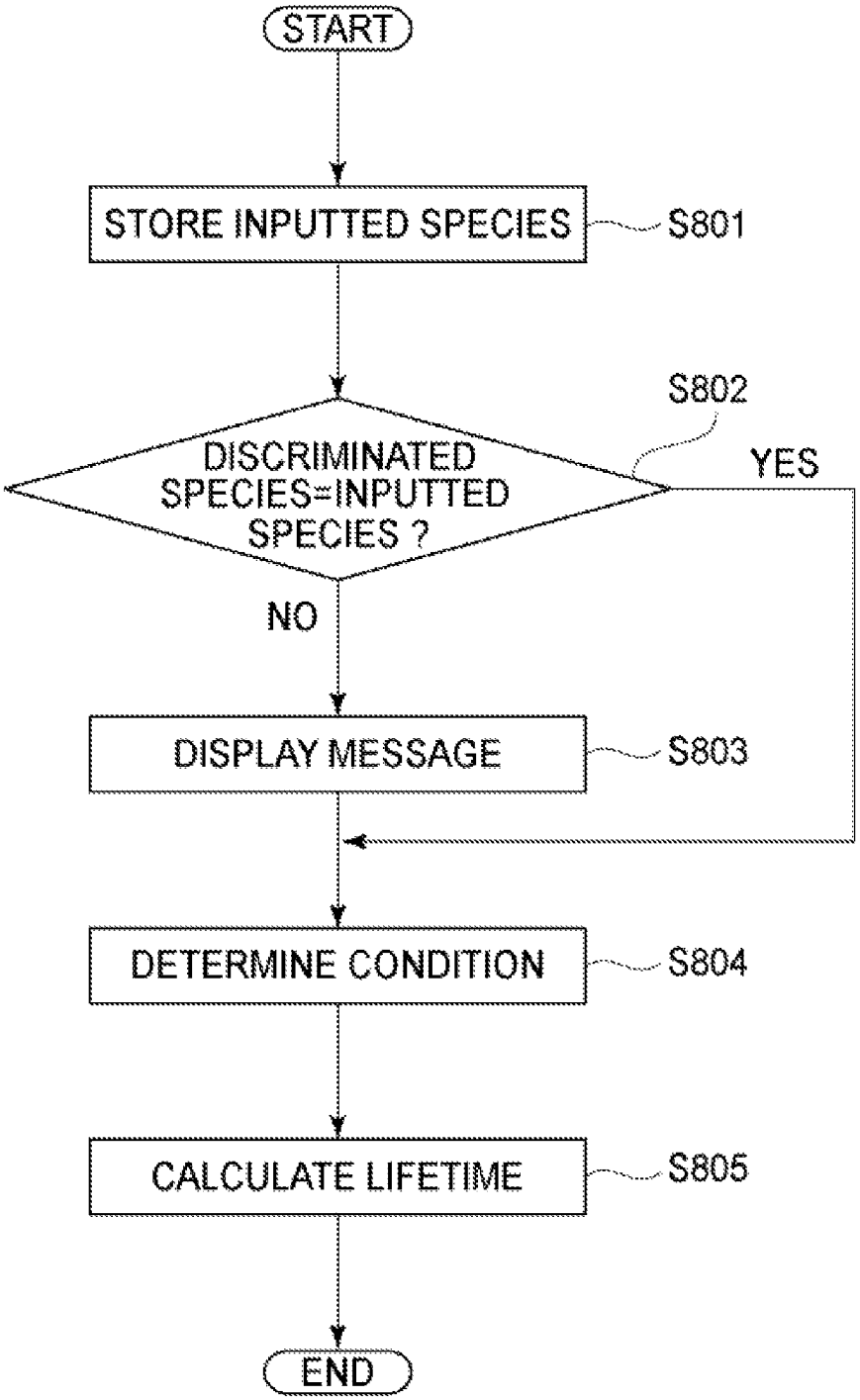
FIG. 6 is a flowchart for illustrating an operation of the image forming apparatus in Embodiment 1.

FIG. 6 is a flowchart showing a process sequence of lifetime calculation of the fixing portion 21 carried out by the control calculation portion 10. The process of FIG. 6 is started in the case where the general user executes a print job, and is executed by the CPU 10*a* of the control calculation portion 10. As described above, the process of FIG. 6 will be described using the names of the control blocks shown in the controller 51 in FIG. 3.

In a step 801 (S801), the sheet kind inputting portion 52 stores, in the sheet kind storing portion 53, the sheet (paper) kind of the recording material P inputted from the control panel 35 or the host computer 41. In S802, the sheet kind comparing portion 59 reads the sheet kind of the recording material P stored (inputted) in the inputted sheet kind storing portion 53 and the sheet kind (discriminated from the characteristic value) of the recording material P stored in the discriminated sheet kind storing portion 58 and discriminated whether or not these sheet kinds are the same sheet kind. As described above, the sheet kind stored in the discriminated sheet kind storing portion 58 in inputted from the management host computer 42, and on the basis of the characteristic value information of the recording material P stored in the inputted sheet characteristic value storing portion 62 by the sheet characteristic inputting portion 61, the sheet kind discriminating portion 57 sets the sheet kind. In the case where the sheet kind comparing portion 59 discriminates that the inputted sheet kind and the sheet kind discriminated from the characteristic value are the same, the process goes to S804, and in the case where the sheet kind comparing portion 59 discriminates that these sheet kinds are not the same, the process goes to S803. In S803, the warning notifying portion 60 sends a characteristic value checking message for promoting the user to check the characteristic value of the recording material P to the management host computer 42 via the input output processing portion 50. When the management host computer 42 receives the characteristic value checking message, the management host computer 42 displays the characteristic value checking message for notifying the management user of the message.

In S804, the image forming condition determining portion 54 determines an image forming condition during the printing of the image on the recording material P on the basis of the sheet kind stored in the inputted sheet kind storing portion 53. Incidentally, in the process of S802, the image forming condition determining portion 54 determines the image forming condition on the basis of the sheet kind stored in the inputted sheet kind storing portion 53 irrespective of whether or not the inputted sheet kind and the sheet kind discriminated from the characteristic value are the same.

In S805, the feeding controller 55 drives feeding rollers including the pressing roller 21*a* of the fixing portion 21 on the basis of the feeding speed of the recording material P which is one of the image forming condition determined by the image forming condition determining portion 54. Onto the recording material P, the toner image formed by the image forming portion is transferred, and heating and pressing are made by the fixing portion 21, so that the toner image is fixed on the recording material P and the recording material P is discharged onto a sheet discharge tray 30. Then, the feeding controller 55 stores the number of sheets of the fed recording material P and the number of rotations of the heating film 211 as a feeding history with a current image forming apparatus. Then, the lifetime calculating portion 63 reads the number of sheets of the recording material P and the number of rotations of the heating film 211 which are stored as the feeding history with the current image forming apparatus in the feeding history recording portion 56. Then, the lifetime calculating portion 63 calculates the abrasion amount when the toner image is printed on the recording material P with the current image forming apparatus and the abrasion amount when the heating film 211 is rotated.

Then, the lifetime calculating portion 63 reads the stiffness and the filler content which are characteristic values of the recording material P stored in the inputted sheet characteristic value storing portion 62, and acquires the correction efficiency from the matrix of FIG. 5 depending on the stiffness and the filler content. Then, the lifetime calculating portion 63 corrects, using the acquired correction efficiency, the abrasion amount during the printing of the toner image on the recording material P and the abrasion amount during the rotation of the heating film 211 which are calculated with the current image forming apparatus. Then, the lifetime calculating portion 63 renews the integrated abrasion amounts 1 and 2 by adding the corrected abrasion amount during the printing of the toner image on the recording material P and the corrected abrasion amount during the rotation of the heating film 211 to the integrated abrasion amounts 1 and 2, respectively. The lifetime calculating portion 63 uses, as the integrated abrasion amount of the heating film 211, a larger integrated abrasion amount of the integrated abrasion amounts 1 and 2 and makes the lifetime calculation according to the above-described formula (1), so that the process is ended.

In S805, the lifetime calculating portion 63 calculates the abrasion amount on the basis of the stiffness and the filler content which are the characteristic values of the recording material P stored in the input output characteristic value storing portion 62 even in the case where the inputted sheet kind and the sheet kind discriminated from the characteristic values are not the same. For example, in the case where the inputted sheet kind and the sheet kind discriminated from the characteristic values are not the same, the management user may also calculated the abrasion amount by using the stiffness and the filler content which are characteristic values of the recording material P which are renewed correspondingly to the characteristic value checking message in S804. As a result, the abrasion amount can be further accurately calculated, with the result that it is possible to make the lifetime calculation with high accuracy.

As described above, in the case where the general user inputs the kind (sheet kind) of the recording material P into the image forming apparatus, the image forming apparatus cannot discriminate whether the recording material P to be actually used is changed to the recording material P different in kind therefrom or only data setting of the sheet kind is changed. In the case where the kind of the recording material P to be actually used is changed, when the management user continuously calculates the lifetime of the fixing portion 21 by using the recording material characteristic values inputted in advance, there is a liability that the lifetime calculated from the actual abrasion amount of the parting layer 211S and the lifetime calculated from the abrasion amount acquired by the prediction calculation do not coincide with each other. Therefore, by employing the above-described constitution, in the case where the general user inputs the kind of the recording material P into the image forming apparatus, the image forming apparatus is capable of prompting the management user to input the characteristic values of the recording material P depending on the inputted kind of the recording material P. As a result, the management user checks the kind of the recording material P which is actually used, and then inputs a proper characteristic value, so that the lifetime of the fixing portion 21 can be calculated with accuracy depending on the actually used recording material P. On the other hand, in the case where the kind of the recording material P to be used is not changed in actuality but only the data of the kind of the recording material P is changed, it is possible to maintain the accuracy of the lifetime calculation by promoting the management user to check the sheet kind of the recording material P by the image forming apparatus.

In this embodiment, in the lifetime calculation, the degree in which the abrasion amount approaches the lifetime value is represented by the percentage, but as another method, for example, the degree may also be represented by a remaining number of sheets of the recording materials capable of being subjected to the printing until the fixing portion reaches the end of the lifetime thereof. Further, it is possible to use an arbitrary method such that the degree of represented on the basis of the number of days in view of a use status until then.

As described above, according to this embodiment, it is possible to accurately estimate a degree of a lowering in performance of the rotation feeding means depending on the paper kind of the recording material to be used.

Embodiment 2

In Embodiment 1, the general user sets the information on the kind of the recording material P used for the printing through the menu displayed on the control panel of the image forming apparatus. In this embodiment, an example in which the information on the kind of the recording material P used for the printing is automatically set on the basis of a detection result of a sensor for detecting a thickness of the sheet to be fed will be described.

[Sheet Thickness Sensor]

Figure 7:
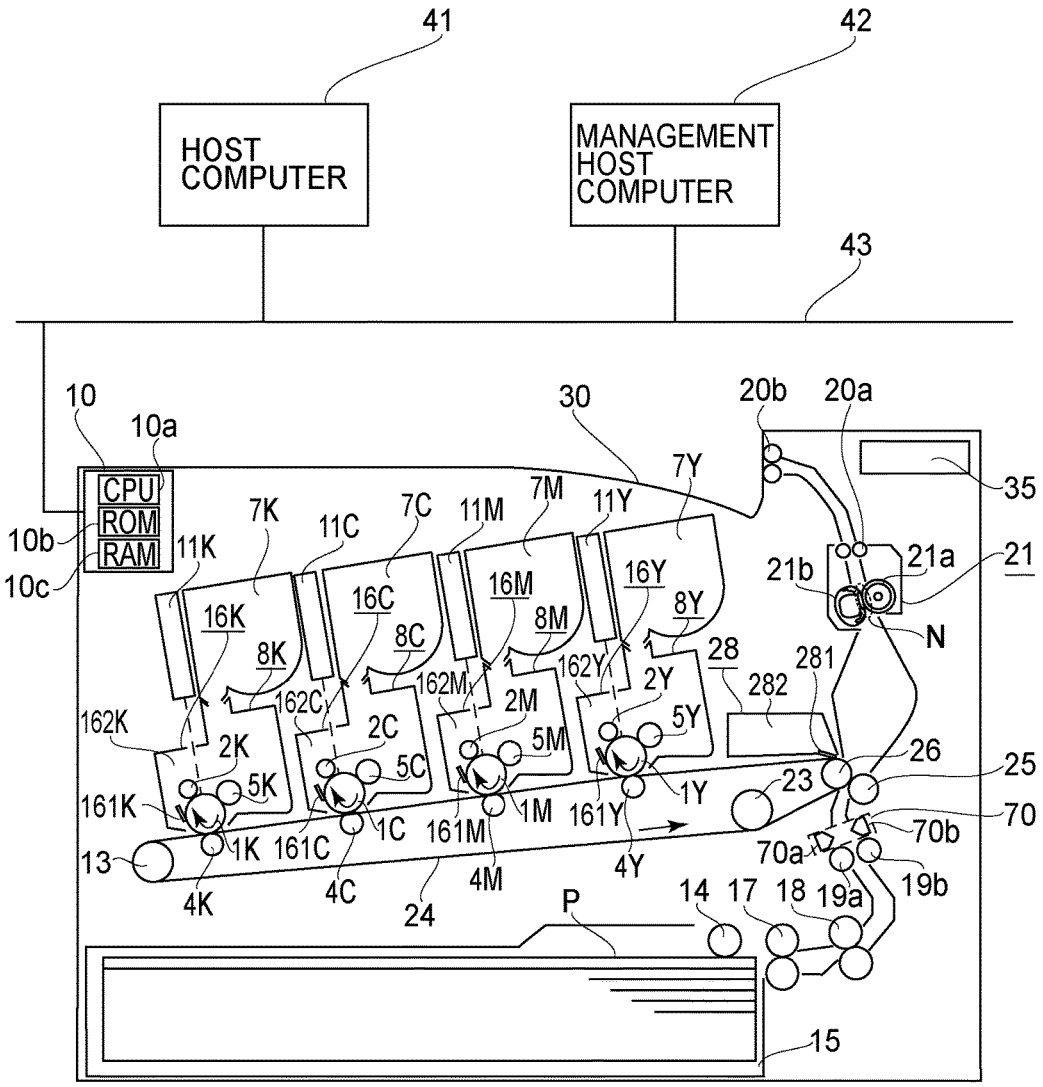
FIG. 7 is a schematic sectional view of an image forming apparatus in Embodiment 2.

FIG. 7 is a schematic sectional view of the image forming apparatus in this embodiment. In FIG. 7, compared with FIG. 1 in Embodiment 1, a sheet thickness sensor 70 is added, but other constitutions are similar to those in FIG. 1 of Embodiment 1. Similar constituent elements are represented by the same reference numerals or symbols and will be omitted from description.

A sheet thickness sensor 70 as a detecting means is provided along a feeding path of the recording material P between the registration roller pair 19*a* and 19*b* and the secondary transfer roller 25. The sheet thickness sensor 70 includes a light-emitting diode 70*a* and a photo-diode 70*b* which are oppositely disposed with respect to the feeding path of the recording material P. The photo-diode 70*b* receives, via the recording material P, light which is emitted from the light-emitting diode 70*a* and with which the fed recording material P is irradiated, but a quantity of the light received by the photo-diode 70*b* varies depending on the thickness of the sheet of the recording material P. The sheet thickness sensor 70 makes output (voltage output) depending on the quantity of the light received by the photo-diode 70*b* to the control calculation portion 10.

[Control Calculation Portion]

Figure 8:
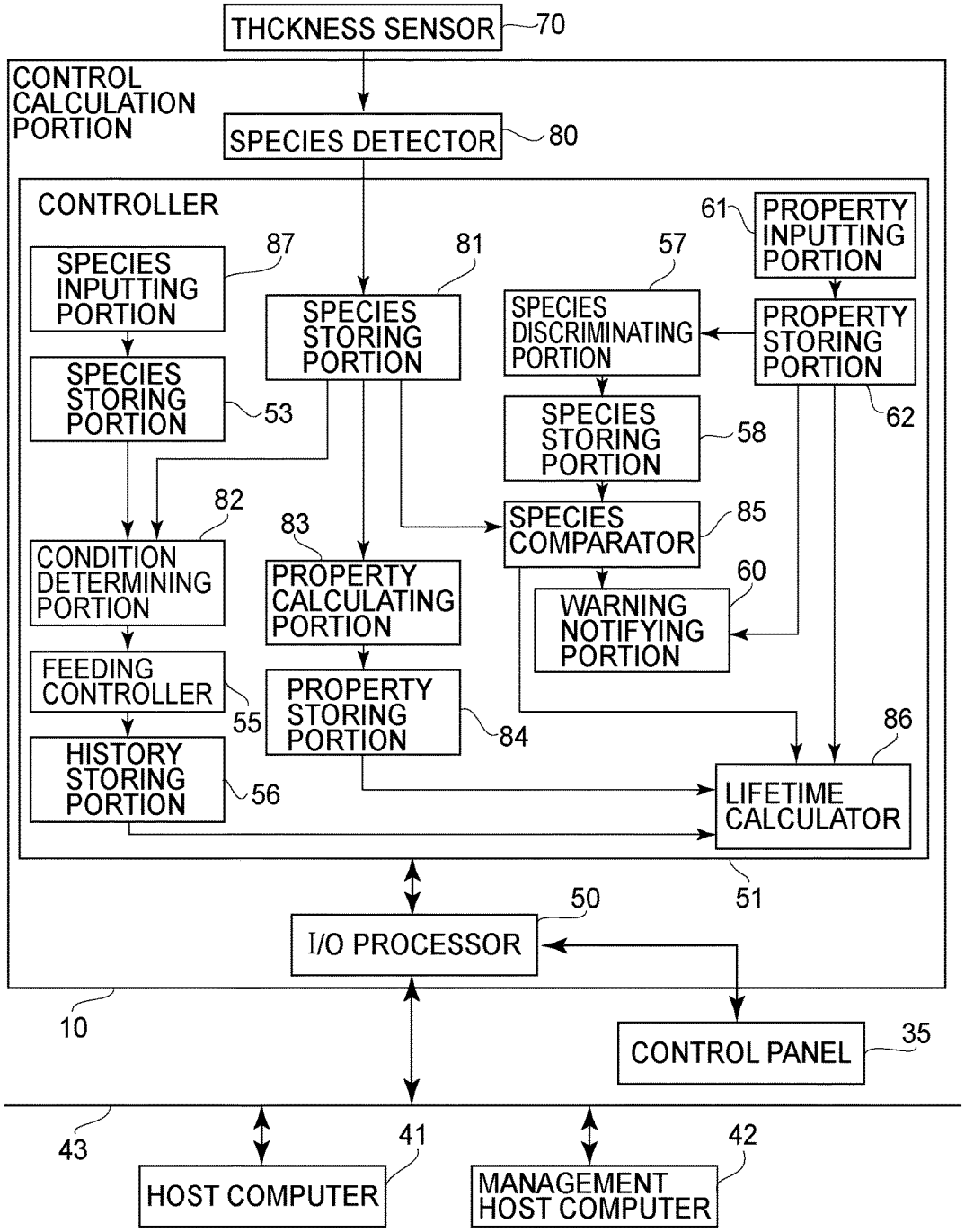
FIG. 8 is a block diagram showing a structure of a control calculation portion of the image forming apparatus in FIG. 2.

FIG. 8 is a function block diagram showing a structure of the control calculation portion 10 of the image forming apparatus in this embodiment. In FIG. 8, constitutions similar to those shown in FIG. 3 of Embodiment 1 are represented by the same reference numerals or symbols and will be omitted from description.

Into a sheet kind detecting portion 80, a signal (voltage signal) based on the quantity of the light received from the light-emitting diode 70*a* by the photo-diode 70*b* via the recording material P is inputted. The sheet kind detecting portion 80 includes an information table in which a voltage value of the signal inputted from the sheet thickness sensor 70 and a sheet kind based on the thickness of the recording material P are associated with each other.

The sheet kind detecting portion 80 classifies the detected category (kind) of the recording material P into any one of three kind of thin paper, plain paper and thick paper, and stores the sheet kind of the recording material P as a detection result in a detected sheet kind storing portion 81. The sheet thickness sensor 70 makes detection of thicknesses of all of the recording materials P to be fed, and outputs a detection result to the sheet kind detecting portion 80. The sheet kind detecting portion 80 stores the detected kind (sheet kind) of the recording material P on the basis of the voltage signal inputted from the sheet thickness sensor 70 irrespective of whether or not the information on the kind of the recording material P is detected by "automatic detection" described later.

A sheet kind inputting portion 87 receives, via the input output processing portion 50 similarly as in the sheet kind inputting portion 52 in Embodiment 1, information on the kind of the recording material P which is selected by the general user from the menu displayed on the control panel 35 and which is used for the printing, and then stores the received information in the inputted sheet kind storing portion 53. In this embodiment, as the information on the kind of the recording material P used for the printing, "automatic detection" is added and is selectable. An image forming condition determining portion 82 determines an image forming condition on the basis of the kind of the recording material stored in the inputted sheet kind storing portion 53 similarly as in the image forming condition determining portion 54 in Embodiment 1. In the case where the sheet kind of the recording material stored in the inputted sheet kind storing portion 53 is "automatic detection", the image forming condition determining portion 82 determines the image forming condition on the basis of the kind of the recording material stored in the detected sheet kind storing portion 81 on the basis of the kind of the recording material detected by the sheet thickness sensor 70.

A sheet characteristic value calculating portion 83 includes an information table in which the kind, the stiffness and the filler content of the recording material P which are shown in (b) of FIG. 4 are associated with each other. In the table shown in (b) of FIG. 4, a left column shows information indicating the kind of the recording material P, in which the plain paper, the thin paper and the thick paper are set at the kind of the recording material P. A center column shows the stiffness (unit: $cm^3/100$) of the recording material P, in which values of the stiffness of the plain paper, the thin paper and the thick paper as the recording material P are 120 $cm^3/100$, and 160 $cm^3/100$, respectively. A right column shows the filler content (U: %) of the recording material P, in which the filler contents of the recording material P is 18.5% irrespective of the kind of the plain paper, the thin paper and the thick paper. The sheet characteristic value calculating portion 83 stores the characteristic values (stiffness and filler content) of the recording material P in a detected sheet characteristic value storing portion 84 on the basis of the information table shown in (b) of FIG. 4 and the kind of the recording material stored in the detected sheet kind storing portion 81.

A sheet kind comparing portion 85 compares the kind of the recording material P stored in the discriminated sheet kind storing portion 58 with the kind of the recording material P stored in the detected sheet kind storing portion 81. In the case where the kind of the recording materials P do not coincide with each other, the sheet kind comparing portion 85 sends a message for checking the characteristic values to the management host computer 42 for causing the warning notifying portion 60 to check the characteristic values. In this embodiment, the sheet kind comparing portion 85 is different from that in Embodiment 1 in that comparison of the sheet kind is made using the kind of the recording material P stored in the detected sheet kind storing portion 81, not using the kind of the recording material P stored in the inputted sheet kind storing portion 53 as in Embodiment 1.

Similarly as in the lifetime calculating portion 63 in Embodiment 1, a lifetime calculating portion 86 makes lifetime calculation of the fixing portion 21 making correction of the abrasion amount based on the characteristic values (stiffness and filler content) of the recording material held by the input output characteristic value storing portion 62. However, at the sheet kind comparing portion 85, in the case where the kind of the recording materials P stored in the detected sheet kind storing portion 81 and the discriminated sheet kind storing portion 58 do not coincide with each other, the lifetime calculating portion 86 corrects the abrasion amount on the basis of the recording material characteristic values of the detected sheet kind storing portion 81 and makes the calculation of the lifetime of the fixing portion 21.

[Lifetime Calculating Process of Fixing Portion]

Figure 9:
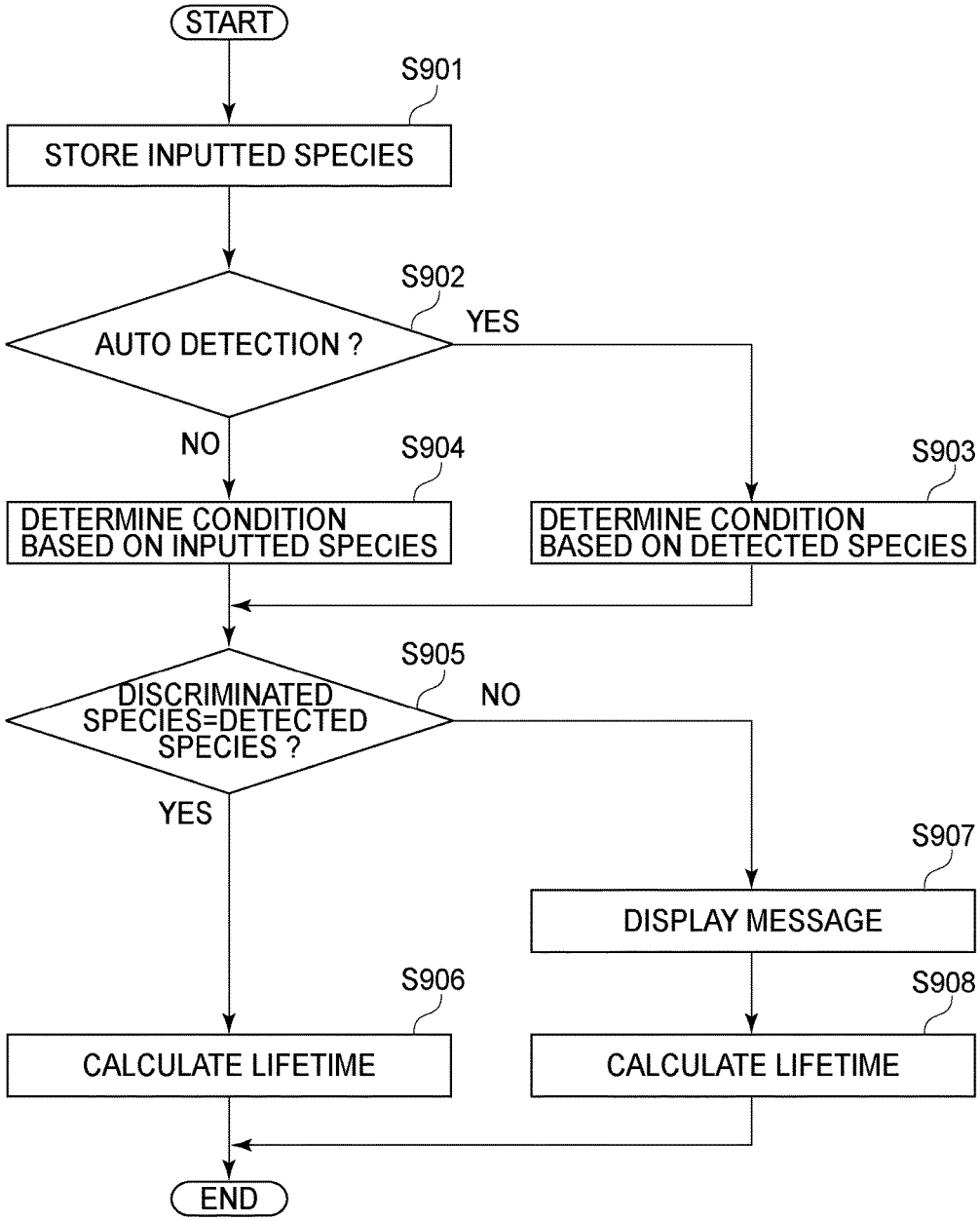
FIG. 9 is a flowchart for illustrating an operation of the image forming apparatus in Embodiment 2.

FIG. 9 is a flowchart showing a process sequence of lifetime calculation of the fixing portion 21 carried out by the control calculation portion 10. The process of FIG. 9 is started in the case where the general user executes a print job, and is executed by the CPU 10*a* of the control calculation portion 10. As described above, the process of FIG. 9 will be described using the names of the control blocks shown in the controller 51 in FIG. 8.

In S901, the sheet kind inputting portion 87 stores, in the sheet kind storing portion 53, the sheet (paper) kind including "automatic detection" of the recording material P inputted from the control panel 35 or the host computer 41. The sheet kind detecting portion 80 classifies the detected kind of the recording material P into any one of the thin paper, the plain paper and the thick paper and stores the classified sheet kind of the recording material P in the detected sheet kind storing portion 81.

In S902, the image forming condition determining portion 82 reads the sheet kind stored in the inputted sheet kind storing portion 53 and discriminates whether or not the inputted sheet kind is "automatic detection". In the case where the inputted sheet kind is discriminated as the "automatic detection" by the image forming condition determining portion 82, the process goes to S903, and in the case where the inputted sheet kind is discriminated as being not the "automatic detection", the process goes to S904. In S903, the image forming condition determining portion 82 determines the image forming condition during the printing of the toner image on the recording material P on the basis of the sheet kind stored in the detected sheet kind storing portion 81. In S904, the image forming condition determining portion 82 determines the image forming condition during the printing of the toner image on the recording material P on the basis of the sheet kind stored in the inputted sheet kind storing portion 53.

In S905, the sheet kind comparing portion 85 discriminates whether or not the information on the sheet kind of the recording material P stored (detected) in the detected sheet kind storing portion 81 and the sheet kind (discriminated from the characteristic value) of the recording material P stored in the discriminated sheet kind storing portion 58 are the same sheet kind. The sheet kind stored in the discriminated sheet kind storing portion 58 in inputted from the management host computer 42, and on the basis of the characteristic value information of the recording material P stored in the inputted sheet characteristic value storing portion 62 by the sheet characteristic inputting portion 61, the sheet kind discriminating portion 57 sets the sheet kind. In the case where the sheet kind comparing portion 85 discriminates that the detected sheet kind and the sheet kind discriminated from the characteristic value are the same, the process goes to S906, and in the case where the sheet kind comparing portion 85 discriminates that these sheet kind are not the same, the process goes to S907.

In S906, the feeding controller 55 stores the number of sheets of the fed recording material P and the number of rotations of the heating film 211 as a feeding history with a current image forming apparatus. Then, the lifetime calculating portion 86 reads the number of sheets of the recording material P and the number of rotations of the heating film 211 which are stored as the feeding history with the current image forming apparatus in the feeding history recording portion 56. Then, the lifetime calculating portion 63 calculates the abrasion amount when the toner image is printed on the recording material P with the current image forming apparatus and the abrasion amount when the heating film 211 is rotated. Then, the lifetime calculating portion 86 reads the stiffness and the filler content which are characteristic values of the recording material P stored in the inputted sheet characteristic value storing portion 62, and acquires the correction efficiency from the matrix of FIG. 5 depending on the stiffness and the filler content. Then, the lifetime calculating portion 86 corrects, using the acquired correction efficiency, the abrasion amount during the printing of the toner image on the recording material P and the abrasion amount during the rotation of the heating film 211 which are calculated with the current image forming apparatus. Then, the lifetime calculating portion 86 renews the integrated abrasion amounts 1 and 2 by adding the corrected abrasion amount during the printing of the toner image on the recording material P and the corrected abrasion amount during the rotation of the heating film 211 to the integrated abrasion amounts 1 and 2, respectively. The lifetime calculating portion 86 uses, as the integrated abrasion amount of the heating film 211, a larger integrated abrasion amount of the integrated abrasion amounts 1 and 2 and makes the lifetime calculation according to the above-described formula (1), so that the process is ended.

In S907, the warning notifying portion 60 sends a characteristic value checking message for promoting the user to check the characteristic value of the recording material P to the management host computer 42 via the input output processing portion 50. When the management host computer 42 receives the characteristic value checking message, the management host computer 42 displays the characteristic value checking message for notifying the management user of the message.

In S908, the feeding controller 55 stores the number of sheets of the fed recording material P and the number of rotations of the heating film 211 as a feeding history with a current image forming apparatus. Then, the lifetime calculating portion 86 reads the number of sheets of the recording material P and the number of rotations of the heating film 211 which are stored as the feeding history with the current image forming apparatus in the feeding history recording portion 56. Then, the lifetime calculating portion 86 calculates the abrasion amount when the toner image is printed on the recording material P with the current image forming apparatus and the abrasion amount when the heating film 211 is rotated. Then, the lifetime calculating portion 86 reads the stiffness and the filler content which are characteristic values of the recording material P stored in the detected sheet characteristic value storing portion 84, and acquires the correction efficiency from the matrix of FIG. 5 depending on the stiffness and the filler content. Then, the lifetime calculating portion 86 corrects, using the acquired correction efficiency, the abrasion amount during the printing of the toner image on the recording material P and the abrasion amount during the rotation of the heating film 211 which are calculated with the current image forming apparatus. Then, the lifetime calculating portion 86 renews the integrated abrasion amounts 1 and 2 by adding the corrected abrasion amount during the printing of the toner image on the recording material P and the corrected abrasion amount during the rotation of the heating film 211 to the integrated abrasion amounts 1 and 2, respectively. The lifetime calculating portion 86 uses, as the integrated abrasion amount of the heating film 211, a larger integrated abrasion amount of the integrated abrasion amounts 1 and 2 and makes the lifetime calculation according to the above-described formula (1), so that the process is ended.

As described above, by employing the above-described constitution, also in the case where the general user actually changed the kind of the recording material P used, the image forming apparatus can make the calculation of the lifetime of the fixing portion 21 on the basis of the kind of the recording material P detected by the sheet thickness sensor 70. As a result, it is possible to suppress a lowering in accuracy of the content calculation of the fixing portion 21. Further, the management user who is prompted to check the kind of the recording material P checks the kind of the actually used recording material P and inputs a proper characteristic value of the recording material again, so that it becomes possible to maintain the accuracy of the calculation of the lifetime of the fixing portion 21.

In the above-described embodiments, as an object to be subjected to the prediction calculation of the degree of deterioration, the heating film 211 was used, but the present invention is not limited thereto. For example, other than the heating film 211, the present invention may also be applied to the pressing roller 21*a* which is a part constituting the fixing portion 21. Further, only the prediction calculation value of the degree of deterioration of the heating film 211 is used in the lifetime calculation of the fixing portion 21, but the lifetime calculation may also be made in comprehensive consideration of the degree of deterioration and the like of the other parts constituting the fixing portion 21 as described above. Further, the present invention is also application to the rotation feeding means in general, which contributes to the feeding of the recording material in contact with the surface of the recording material P, such as the secondary transfer roller 25 or the feeding rollers 17 and 18, other than the fixing portion 21.

The image forming apparatuses in the above-described embodiments include a single sheet feeding cassette, but the above-described embodiments are also applicable to an image forming apparatus including a plurality of sheet feeding cassettes. In the image forming apparatus including the plurality of sheet feeding cassettes, for example, through the menu screen displayed on the control panel 35, the paper kind information on the sheet kind of the recording material P is made settable for each of the sheet feeding cassettes provided in the image forming apparatus. Further, in the host computer 41, e.g., through the menu screen, the paper kind information of the recording material P is made individually settable for each of the sheet feeding cassettes provided in the image forming apparatus. Further, also from the management host computer 42, the data of the stiffness and the filler content of the recording material P are made individually settable for each of the sheet feeding cassettes provided in the image forming apparatus. As a result, for each of the sheet feeding cassettes of the image forming apparatus, the information on the recording material P can be set, with the result that it is possible to achieve effects similarly to those of the above-described embodiments.

In the above-described embodiments, the management host computer 42 is described as a part of the management system for managing (controlling) an operation of a single image forming apparatus through the network circuit 43. The management host computer 42 is capable of effecting data setting management (control) of the thickness, the stiffness and the filler content of the recording material P in not only the single image forming apparatus but also the plurality of image forming apparatuses contacted with each other via the network circuit 43. In the case where the management user manages the plurality of image forming apparatuses and a plurality of recording materials to be used, for an individual image forming apparatus, the management user repetitively makes setting of the parameter information (thickness, stiffness, filler content and the like) of the same recording material P many times. Therefore, when such an information setting output can be performed at one time by the management host computer 42 through the network circuit 43, an output efficiency of the management user can be improved.

As individual discrimination (identification) information of the image forming apparatus contacted through the network circuit 43, an IP address or the like registered for the image forming apparatus is used, and thus individual discrimination of the image forming apparatus can be made using a known method by the management host computer 42. In this manner, the management host computer 42 sends the data of the thickness, the stiffness and the filler content of the recording material P to the plurality of the image forming apparatuses selected from the management host computer 42 for each of the sheet feeding cassettes 15 to at one time. As a result, by using the data of the thickness, the stiffness and the filler content of the recording material P inputted via the network circuit 43, the control calculation portion 10 of each of the image forming apparatuses can make the lifetime calculation of the fixing portion 21 with accuracy. Further, a result of the lifetime calculation made in each of the image forming apparatuses is sent to the management host computer 42 via the network circuit 43. As a result, the management host computer 42 can hold the lifetime calculation result of the fixing portion 21 of each of the image forming apparatuses as one of pieces of maintenance management information, so that the management host computer 42 can also alleviate a management load of the management user.

As described above, according to this embodiment, depending on the paper kind of the recording material to be used, the degree of the lowering in performance of the rotation feeding means can be estimated with accuracy.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-213023 filed on Oct. 29, 2015, which is hereby incorporated by reference herein in its entirety.

What is claimed is:

1. An image forming apparatus comprising:

a stacking portion where a recording material is stacked;

a rotation member for feeding the recording material;

an image forming unit for forming an image on the recording material fed by the rotation member;

a storing unit for storing information concerning the recording material stacked on the stacking portion in association with the stacking portion, wherein the information concerning the recording material includes kind information of the recording material;

an inputting unit for inputting kind information of the recording material; and an obtaining unit for obtaining a degree of deterioration of the rotating member depending on the kind information of the recording material, wherein when the kind information of the recording material inputted by the inputting unit is different from the kind information of the recording material stored in the storing unit, the image forming unit forms the image on the recording material in an image forming condition determined on the basis of the kind information of the recording material inputted by the inputting unit, and the obtaining unit obtains the degree of deterioration of the rotation member on the basis of the information concerning the recording material stored in the storing unit.

2. The image forming apparatus according to claim 1, further comprising an outputting unit for outputting a notifying message when the kind information of the recording material inputted by the inputting unit is different from the kind information of the recording material stored in the storing unit.

3. The image forming apparatus according to claim 2, wherein after the notifying message is outputted, the obtaining unit obtains the degree of deterioration of the rotation member on the basis of renewed information concerning the recording material stored in the storing unit.

4. The image forming apparatus according to claim 1, wherein the inputting unit includes a detecting unit for detecting the kind information of the recording material fed by the rotation member, wherein when the kind information of the recording material detected by the detecting unit is different from the kind information of the recording material stored in the storing unit, the obtaining unit obtains the degree of deterioration of the rotation member on the basis of the kind information of the recording material detected by the detecting unit.

5. The image forming apparatus according to claim 4, wherein when the kind information of the recording material detected by the detecting unit is the same as the kind information of the recording material stored in the storing unit, the obtaining unit obtains the degree of deterioration of the rotation member on the basis of the information concerning the recording material stored in the storing unit.

6. The image forming apparatus according to claim 4, wherein the detecting unit includes an emitting portion configured to emit light and a receiving portion configured to receive, via the recording material, the light which is emitted from the emitting portion.

7. The image forming apparatus according to claim 1, wherein the obtaining unit obtains the degree of deterioration of the rotation member on the basis of stiffness of the recording material and a content of a filler contained in the recording material which are included in the information concerning the recording material stored in the storing unit.

8. The image forming apparatus according to claim 7, wherein the obtaining unit acquires an abrasion amount, as the degree of deterioration, obtained by multiplying at least one of an abrasion amount per page and an abrasion amount per rotation when the recording material is fed by the rotation member by an efficiency depending on the stiffness and the content of the filler and then by integrating a resultant value.

9. The image forming apparatus according to claim 8, wherein the obtaining unit sets the efficiency at a smaller value with a smaller value of the stiffness and with a smaller content of the filler.

10. The image forming apparatus according to claim 1, wherein the rotation member is a fixing portion for fixing a toner image on the recording material, wherein the fixing portion includes a heating film and a pressing roller and feeds the recording material while nipping the recording material in a fixing nip formed by the heating film and the pressing roller.

11. The image forming apparatus according to claim 1, wherein the image forming unit includes an image bearing member, a developing portion for developing an electrostatic latent image formed on the image bearing member, a transfer portion for transferring a toner image obtained by developing the electrostatic latent image by the developing portion onto the recording material, and a fixing portion for fixing the toner image transferred by the transfer portion on the recording material, and wherein the image forming condition is at least one of a feeding speed of the recording material, a value of a voltage applied to the developing portion, a value of a voltage applied to the transfer portion, and a temperature of the fixing portion.

12. An image forming apparatus comprising:

a stacking portion where a recording material is stacked;

a fixing portion for fixing a toner on the recording material while feeding the recording material;

a storing unit for storing information concerning the recording material stacked on the stacking portion in association with the stacking portion, wherein the information concerning the recording material includes kind information of the recording material;

an inputting unit for inputting kind information of the recording material; and an obtaining unit for obtaining a degree of deterioration of the fixing portion depending on the kind information of the recording material, wherein when the kind information of the recording material inputted by the inputting unit is different from the kind information of the recording material stored in the storing unit, the fixing portion fixes the toner image on the recording material at a temperature determined on the basis of the kind information of the recording material inputted by the inputting unit, and the obtaining unit obtains the degree of deterioration of the fixing portion on the basis of the information concerning the recording material stored in the storing unit.

13. A management system comprising:

a plurality of image forming apparatuses; and a management apparatus connected with the image forming apparatuses via a network circuit, wherein each of the image forming apparatuses includes, a plurality of stacking portions where a recording material is stacked, a rotation member for feeding the recording material, an image forming unit for forming an image on the recording material fed by the rotation member, a storing unit for storing information concerning the recording material stacked on the stacking portion in association with the stacking portion, wherein the information concerning the recording material includes kind information of the recording material, an inputting unit for inputting kind information of the recording material, and an obtaining unit for obtaining a degree of deterioration of the rotation member depending on the kind information of the recording material, wherein the management apparatus includes, a setting unit capable of setting information concerning the recording material stacked on each of the stacking portions of the image forming apparatuses, for each of the stacking portions, wherein the storing unit stores the information concerning the recording material set by the setting unit, and wherein when the kind information of the recording material inputted by the inputting unit is different from the kind information of the recording material stored in the storing unit, the image forming unit forms the image on the recording material in an image forming condition determined on the basis of the kind information of the recording material inputted by the inputting unit, and the obtaining unit obtains the degree of deterioration of the rotation member on the basis of the information concerning the recording material stored in the storing unit.

14. The management system according to claim 13, wherein the image forming apparatus sends a notifying message to the management apparatus when the kind information of the recording material inputted by the inputting unit is different from the kind information of the recording material stored in the storing unit.

15. The management system according to claim 14, wherein after the notifying message is sent, the obtaining unit obtains the degree of deterioration of the rotation member on the basis of information concerning the recording material renewed by the setting unit and stored in the storing unit.

16. The management system according to claim 13, wherein the inputting unit includes a detecting unit for detecting the kind information of the recording material fed by the rotation member, wherein when the kind information of the recording material detected by the detecting unit is different from the kind information of the recording material stored in the storing unit, the obtaining unit obtains the degree of deterioration of the rotation member on the basis of the kind information of the recording material detected by the detecting unit.

17. The management system according to claim 16, wherein when the kind information of the recording material detected by the detecting unit is the same as the kind information of the recording material stored in the storing unit, the obtaining unit obtains the degree of deterioration of the rotation member on the basis of the information concerning the recording material stored in the storing unit.

18. The management system according to claim 16, wherein the detecting unit includes an emitting portion configured to emit light and a receiving portion configured to receive, via the recording material, the light which is emitted from the emitting portion.

19. The management system according to claim 13, wherein the obtaining unit obtains the degree of deterioration of the rotation member on the basis of stiffness of the recording material and a content of a filler contained in the recording material which are included in the information concerning the recording material stored in the storing unit.

20. The management system according to claim 19, wherein the obtaining unit acquires an abrasion amount, as the degree of deterioration, obtained by multiplying at least one of an abrasion amount per page and an abrasion amount per rotation when the recording material is fed by the rotation member by an efficiency depending on the stiffness and the content of the filler and then by integrating a resultant value.

21. The management system according to claim 20, wherein the obtaining unit sets the efficiency at a smaller value with a smaller value of the stiffness and with a smaller content of the filler.

22. The management system according to claim 13, wherein the rotation member is a fixing portion for fixing a toner image on the recording material, wherein the fixing portion includes a heating film and a pressing roller and feeds the recording material while nipping the recording material in a fixing nip formed by the heating film and the pressing roller.

23. The management system according to claim 13, wherein the image forming unit includes an image bearing member, a developing portion for developing an electrostatic latent image formed on the image bearing member, a transfer portion for transferring a toner image obtained by developing the electrostatic latent image by the developing portion onto the recording material, and a fixing portion for fixing the toner image transferred by the transfer portion on the recording material, and wherein the image forming condition is at least one of a feeding speed of the recording material, a value of a voltage applied to the developing portion, a value of a voltage applied to the transfer portion, and a temperature of the fixing portion.

24. A management system comprising:

a plurality of image forming apparatuses; and a management apparatus connected with the image forming apparatuses via a network circuit, wherein each of the image forming apparatuses includes, a plurality of stacking portions where a recording material is stacked, a fixing portion for fixing an toner image on the recording material while feeding the recording material;

a storing unit for storing information concerning the recording material stacked on the stacking portion in association with the stacking portion, wherein the information concerning the recording material includes kind information of the recording material, an inputting unit for inputting kind information of the recording material, and an obtaining unit for obtaining a degree of deterioration of the fixing portion depending on the kind information of the recording material, wherein the management apparatus includes, a setting unit capable of setting information concerning the recording material stacked on each of the stacking portions of the image forming apparatuses, for each of the stacking portions, wherein the storing unit stores the information concerning the recording material set by the setting unit, and wherein when the kind information of the recording material inputted by the inputting unit is different from kind information of the recording material stored in the storing unit, the fixing portion fixes the toner image on the recording material at a temperature determined on the basis of the kind information of the recording material inputted by the inputting unit, and the obtaining unit obtains the degree of deterioration of the fixing portion on the basis of the information concerning the recording material stored in the storing unit.

* * * * *